United States Patent [19]

Wu

[11] Patent Number: 4,629,247

[45] Date of Patent: Dec. 16, 1986

[54] INFANT'S CHAIR

[76] Inventor: Ching-Tana Wu, No. 33, Lane 103, Han Sheng E. Road, Penchiao City, Taiwan

[21] Appl. No.: 735,339

[22] Filed: May 17, 1985

Related U.S. Application Data

[63] Continuation-in-part of Ser. No. 649,895, Sep. 12, 1984, abandoned.

[51] Int. Cl.[4] ..... H47B 39/00

[52] U.S. Cl. ..... 297/174; 108/97

[58] Field of Search ..... 297/174, 135, 217, 257, 297/134; 108/90, 97, 98, 64, 45; 248/205.1, DIG. 14; 267/155, 58, 59, 156

[56] References Cited

U.S. PATENT DOCUMENTS

| | | | |
|---|---|---|---|
| Re. 23,339 | 2/1951 | Ducey | 297/174 |
| 2,451,667 | 10/1948 | Ducey | 297/174 |
| 2,644,506 | 7/1953 | Pollack et al. | 297/174 X |
| 2,688,481 | 9/1954 | Bergquist | 267/58 |
| 2,692,098 | 10/1954 | Schmued et al. | 267/59 X |
| 2,707,987 | 5/1955 | Gibson | 297/174 |
| 3,126,226 | 3/1964 | Johnson | 297/174 |
| 3,133,760 | 5/1964 | Robinson | 108/97 X |
| 3,397,010 | 8/1968 | Leimgruber | 297/174 |
| 3,977,528 | 8/1976 | Berger | 108/64 X |
| 4,312,535 | 1/1982 | Smith | 297/174 |
| 4,469,373 | 9/1984 | Simmons et al. | 297/174 |
| 4,506,928 | 3/1985 | Marion | 297/174 |

FOREIGN PATENT DOCUMENTS

| | | | |
|---|---|---|---|
| 817805 | 7/1969 | Canada | 267/155 |
| 386779 | 4/1965 | Switzerland | 267/58 |

*Primary Examiner*—William E. Lyddane
*Assistant Examiner*—Thomas A. Rendos
*Attorney, Agent, or Firm*—McGlew and Tuttle

[57] ABSTRACT

An infant's chair for firmly fastening on a table is disclosed in the present invention. The infant's chair utilizes an accommodating device for holding an infant's body thereon, and two supporting members for securely supporting the accommodating device on the edge portion of the table without attaching it to the ground.

5 Claims, 7 Drawing Figures

INFANT'S CHAIR

CROSS-REFERENCE TO RELATED APPLICATIONS

This is a continuation-in-part of U.S. patent application Ser. No. 649,895, filed Sept. 12, 1984, now abandoned.

BACKGROUND OF THE INVENTION

The present invention is related to a supporting member for an infant's chair, and more particularly to a supporting member for firmly securing an infant's chair onto the edge portion of a table, or the like.

The most common use of an infant's chair secured on a table is shown in FIG. 1. Such a chair utilizes two arms 2, which project from a seat portion, positioned on the top surface of a table and two supporting rods 1 extended from the base part of the arms 2 for abuting against the under surface of the table, so that the chair can be hung on the edge portion of the table. However, such a conventional device still has several disadvantages. The arms 2 and supporting rods 1 cannot be firmly fixed on the table, and thus, the chair may inadvertently slide away when an infant swings or shakes in the seat. This disadvantage may present a danger to an infant and may even cause a life threatening situation. The sliding of the arms 2 may also cause harm to the top surface of the table. Moreover, such a chair device is difficult to carry because the chair itself occupies a large space.

A supporting member according to one preferred embodiment of the present invention to improve on the disadvantages described above.

SUMMARY OF THE INVENTION

One object of the present invention is to provide a supporting member which can be secured on a table, a plate, or the like, and which is adapted to firmly support an infant seat on the edge portion of the table.

Another object of the present invention is to provide an infant's chair which can be firmly affixed on a table without sliding away even if the table surface is rough.

Yet another object of the present invention is to provide an infant's chair which is convenient to assemble and disassemble, and is also easy to fabricate.

In accordance with the present invention, a supporting member comprises a supporting rod having a first end adapted to be placed on the top surface of a plate, and so bent that its second end of the supporting rod is abutting against the under surface of the plate; a connector including two tubes longitudinally juxtaposed, one of the tubes capable of engaging with the first end of the supporting rod, the other tube adapted to be engaged with an arm of a seat which has two arms for being hung on the edge portion of said plate, so that the downward pressure applied on the arm will cause the connector to abut against the top surface of the plate, and the second end of the supporting rod to abut against the under surface of the plate; and an engaging means pivotally connected to the supporting rod, capable of adjusting its angle in relation to the supporting rod, according to the thickness of the plate, to tend upward to firmly engage with the under surface of the plate.

Furthermore, in accordance with another aspect of the present invention, an infant's chair comprises two supporting members defined in the present invention, and an accommodating device for an infant having two arms engaged to the supporting members so as to firmly secure on the plate.

BRIEF DESCRIPTION OF THE DRAWINGS

The present invention will be more fully understood from the following detailed description, taken in connection with the accompanying drawings which form an integral part of this application and in which.

DETAILED DESCRIPTION OF THE PREFERRED EMBODIMENT

Figure 3:
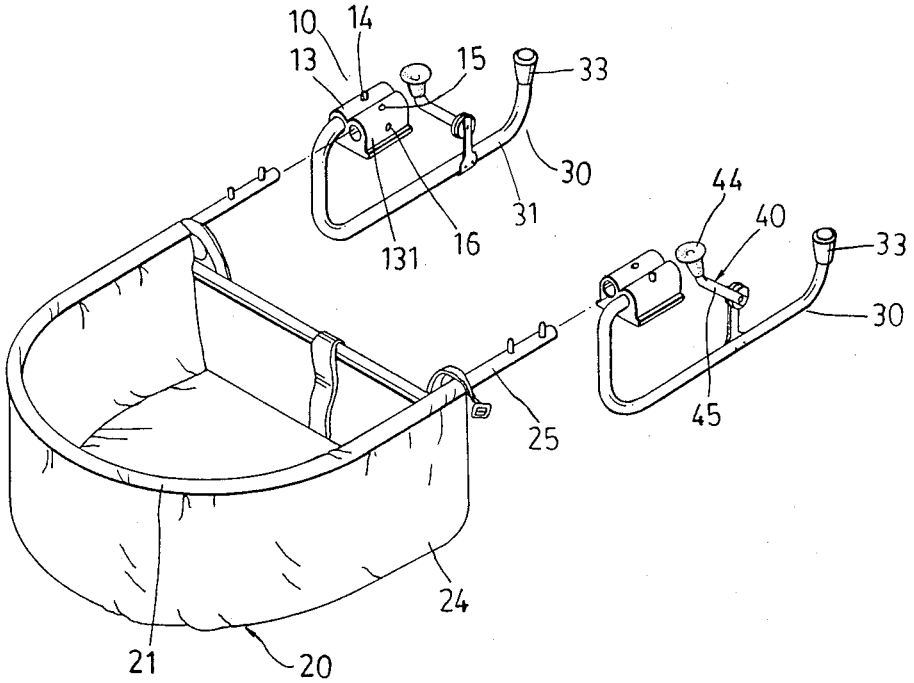
FIG. 3 is a perspective view of the infant's chair in accordance with the present invention, illustrating the accommodating device for an infant to be detached from two supporting members.
Figure 4:
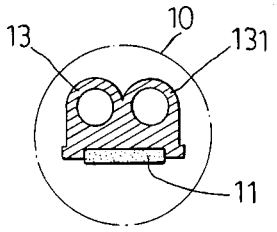
FIG. 4 is an enlarged view in section of the connector of the present invention.

Referring now to the drawings, it should be noted that a like member is designated with a like reference number. In FIG. 3, an infant's chair includes an accommodating device 20 and two supporting members 30, each of which is made of a connector 10 and a supporting rod 31. The connector 10 includes two tubes 13 and 131 longitudinally juxtaposed for respectively engaging with one arm of the accommodating device 20 and a first end of the supporting rod 31, and a supple cushion 11 fastened under the tubes 13 and 131, and is particularly shown in FIG. 4. The tube 13 has a second opening 14 on the top curving part, and the tube 131 respectively has a fifth opening 15 on the top curving part and a sixth opening 16 on the side curving part. A second end of the supporting rod 31 is provided with a protecting cover 33. The accommodating device 20 is made of a U-shaped frame 21 and a flexible seat 24 mounted on the U-shaped frame 21 for accommodating an infant.

Figure 5:
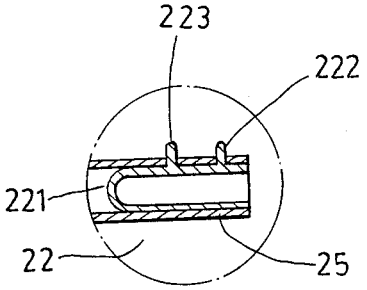
FIG. 5 is an enlarged view in section of a locking member of the present invention.

The engagements between the two tubes 13, 131 and the corresponding supporting rod 31 and one arm of the U-shaped frame 21 are achieved by utilizing a locking member 22 provided within the supporting rod 31 and the U-shaped frame 21. Since the engagements are accomplished by use of a similar method, one arm 25 of the U-shaped frame 21 engaging with the connector 10 is described hereinafter as an exemplar, whereby the other engaged relationships will therefore be easily rendered understandable. The locking member 22, particularly shown by an enlarged cross sectional view of the arm 25 of the U-shaped frame 21 in FIG. 5, includes a leaf spring 221 having one end welded to the inner surface of the arm 25 and the other end which has a first protuberance 222 protruding through a third opening on the arm 25. When the arm 25 is inserted into the tube 13 which inner diameter is larger than the outer diameter of the arm 25, the first protuberance 222 is depressed inside the arm 25 and held in place by the bias force of the leaf spring 221. When the inserted arm 25 passes over the fifth opening 15 or the sixth opening 16, the biasing action of the leaf spring 221 forces the first protuberance 222 into the fifth opening 15 or the sixth opening 16, thereby locking the U-shaped frame 21 with respect to the connector 10. Further, the locking member 22 may include a second protuberance 223 protruding through a fourth opening at the place which is close to the first protuberance 222 and outside the connector when the arm is engaged with the connector by the first protuberance 222. By manually pressing down the second protuberance 223, the first protuberance 222 will be simutaneously moved into said arm 25, so that the arm 25 can be easily disengaged with the connector 10.

Figure 1:
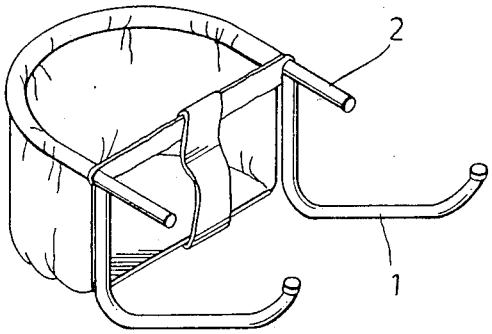
FIG. 1 PRIOR ART
FIG. 1 is a perspective view of a conventional infant's chair.
Figure 2:
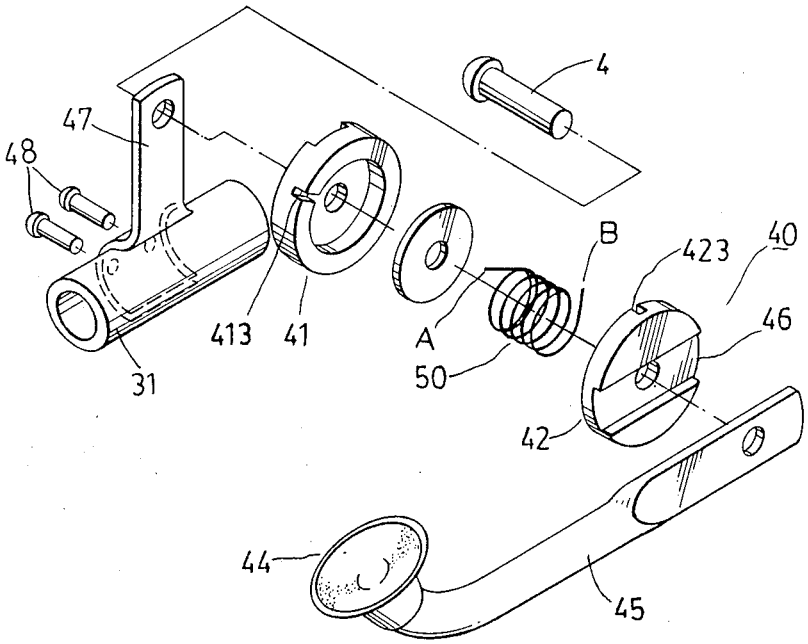
FIG. 2 is an exploded perspective view of an engaging means according to one preferred embodiment of the present invention.

Two engaging means 40 are pivotally connected to the supporting rods 31, respectively, for adjusting their angles in relation to the supporting rods 31, according to the thickness of the plate, so as to tend upward to firmly engage with the under surface of the plate. Referring back to FIG. 2, each engaging means 40 includes a stationary wheel 41, a rotating wheel 42, and an engaging rod 45 pivotally connected together by a rivet 4. The stationary wheel 41 is further fastened on the supporting rod 31 steadily at a groove thereof through a stem 47 which is secured on the supporting rod by two rivets 48. The engaging rod 45 has one end affixed on a groove 46 of the rotating wheel 42 and the other end engaged with a sucker 44. A torsional spring is provided within a preserved chamber between the stationary wheel 41 and the rotating wheel 42 by situating its one end A in a slot 413 on the stationary wheel 41 and the other end B in a slot 423 on the rotating wheel 42. The torsional spring 50 is preferably preset to bias the engaging rod 45 upward until it reaches a position vertical to the supporting rod 31.

Figure 7:
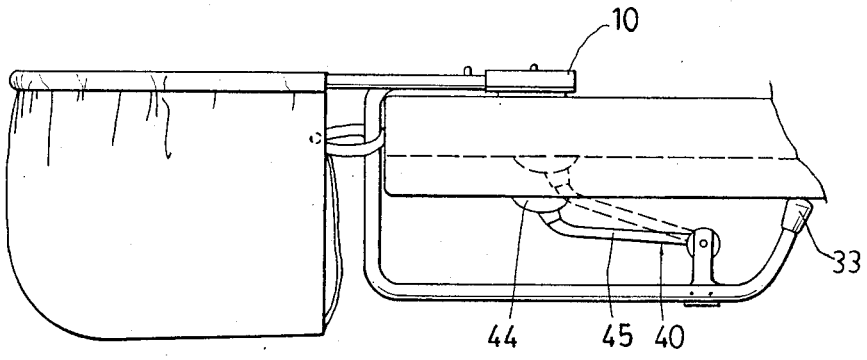
FIG. 7 is a side elevational view illustrating that the infant's chair of FIG. 3 is affixed on the edge portion of a plate.

According to the above structure, an assembled infant's chair can be firmly secured on the edge portion of the plate as shown in FIG. 7. Two connectors 10 respectively engaged with the arms 25 of the U-shaped frame 21 and two first ends of the supporting rods 31 are placed on the top surface of the plate, and the supporting rods 31 are so bent that their second ends are abutting against the under surface of the plate. Two engaging means 40 adjust their angles in relation to the supporting rods 31, respectively, according to the thickness of the plate, to tend upward to firmly engage with the under surface of the plate. The downward pressure applied from the accommodating device 20 will cause the connectors 10 and the second ends of the supporting rods 31 to firmly abut against the top and under surfaces of the plate respectively. Even when the plate is rough, the engaging means 40 can adjust the infant's chair to a steady state. In addition, by use of the suckers 44 respectively provided at the free ends of the engaging rods 45 to cling on to the under surface of the plate, the infant's chair will not slide away when the infant swings or shakes. Thus the infant's chair of the present invention is securely fastened on the plate, thereby greatly reducing the probability of an accident. Further, the supple cushions 11 and the protecting covers 33 will prevent the top surface and the under surface of the plate from being harmed by the tubes 13, 131 and the second ends of the supporting rods 31 respectively.

Figure 6:
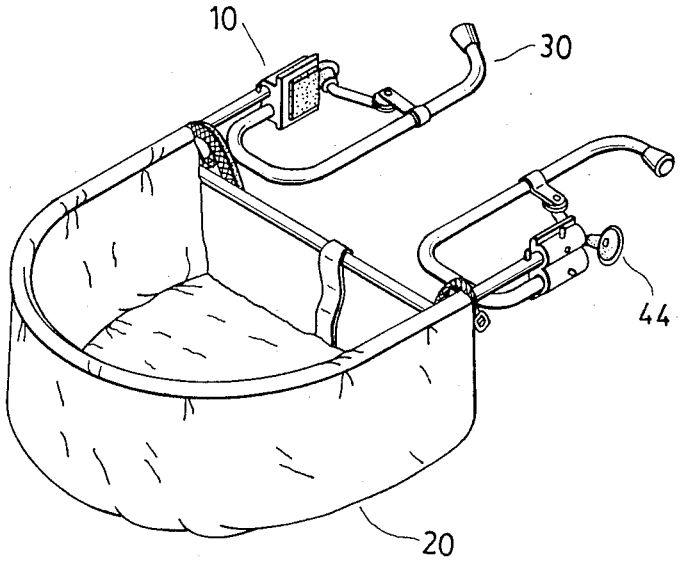
FIG. 6 is a perspective view of the infant's chair of FIG. 3 upon its collapsed position.

According to the above structure, the infant's chair can be extended when it is in use, and be collapsed when it is not in use. When the infant's chair is in use, the first protuberances 222 of the locking members 22 in the arms 25 respectively protrude out of the fifth openings 15 (first locking position). When the infant's chair is not in use, the first protuberances 222 respectively protrude out of the sixth openings 16 (second locking position). At the first locking position the U-shaped frame 21 and the supporting rods 31 are on different planes, while at the second locking position the U-shaped frame 21 and the supporting rods 31 are on the horizontal plane as shown in FIG. 6. To turn over the infant's chair from the first locking position to the second locking postion or the collapsed position, first, press down the second protuberances 223 to disengage the arms 25 from the connectors 10, turn the supporting members 90 degrees in relation to the U-shaped frame 21, and then loose the second protuberances 223 to engage the arms 25 with the connectors 10. Thus, the space occupied by the infant's chair upon its collapsed postion is significantly reduced for easy carrying.

While the invention has been described in connection with what is presently considered to be the most practical and preferred embodiment, it is to be understood that the invention is not to be limited to the disclosed embodiment but on the contrary, is intended to cover various modifications and equivalent arrangements included within the spirit and scope of the appended claims which scope is to be accorded the broadest interpretation so as to encompass all such modification and equivalent structure.

What is claimed is:

1. An infant's chair comprising:

an accommodating device for an infant having two arms projecting therefrom; and two supporting members, each supporting member comprising a supporting rod having a first end placed on the top surface of a plate, and so bent that its second end of said supporting rod is abutting against the under surface of said plate; a connector including two tubes longitudinally juxtaposed, one of said tubes capable of engaging with said first end of said supporting rod, the other tube engaged with one of said arms of said accommodating device, so that the downward pressure applied on said arm will cause said connector to abut against the top surface of said plate, and cause said second end of said supporting rod to press in an opposite direction against the under surface of said plate; and an engaging means pivotally connected to said supporting rod, capable of adjusting its angle in relation to said supporting rod, according to the thickness of said plate, to tend upward to firmly engage with the under surface of said plate, said engaging means including a sucker to cling on to the under surface of said plate, a stationary wheel fastened on said supporting rod; a rotating wheel pivotally connected to said stationary wheel; an engaging rod fastened on said rotating wheel at one end therof, and engaged with said sucker at the other end thereof; and a torsional spring provided between said stationary wheel and said rotating wheel, said accommodating device including a U-shaped frame and a flexible seat mounted on said U-shaped frame, each arm of said accommodating device further comprising a locking member for locking said arm with respect to said connector at a first locking position when said infant's chair is in use, and for locking said armk with respect to said connector at a second locking position when said infant's chair is not in use, wherein at said first locking position said U-shaped frame and said supporting members are on different planes, and at said second locking position said U-shaped frame and said supporting members are substantially on the same horizontal plane.

2. An infant's chair as claimed in claim 1, wherein each arm has a third opening near its first end, each connector has a fifth and a sixth opening thereon, and each locking member includes a leaf spring disposed in said arm, and has a first protuberance at one end of said leaf spring for protruding out of said third opening to engage with said fifth opening when at said first locking position, and to engage with said sixth opening when at said second locking position.

3. An infant's chair as claimed in claim 2, wherein each arm further has a fourth opening which is outside said connector when said arm is engaged with said connector, and each locking member further includes a second protuberance positioned at said end of said leaf spring close to said first protuberance and protruding out of said fourth opening for being manually pressed down to simultaneously move said first protuberance into said arm, so that said arm is disengaged from said connector, and is capable of being pivoted between said first locking position and said second locking position.

4. An infant's chair as claimed in claim 3, wherein each connector includes a supple cushion fastened under said tubes.

5. An infant's chair as claimed in claim 4, wherein each supporting rod includes a protecting cover connected to said second end of said supporting rod for protecting the under surface of said plate from being damaged when said second end abuts against said plate.

* * * * *